US011433562B2

(12) United States Patent
Ren et al.

(10) Patent No.: US 11,433,562 B2
(45) Date of Patent: Sep. 6, 2022

(54) RAZOR HEAD

(71) Applicant: WENZHOU MERS R&D LTD., Zhejiang (CN)

(72) Inventors: Chi Ren, Zhejiang (CN); Yanqiu Jin, Zhejiang (CN); Xiangrong Ren, Zhejiang (CN)

(73) Assignee: WENZHOU MERS R&D LTD., Wenzhou (CN)

( * ) Notice: Subject to any disclaimer, the term of this patent is extended or adjusted under 35 U.S.C. 154(b) by 4 days.

(21) Appl. No.: 17/281,001

(22) PCT Filed: Jan. 29, 2019

(86) PCT No.: PCT/CN2019/073775
§ 371 (c)(1),
(2) Date: Mar. 29, 2021

(87) PCT Pub. No.: WO2020/154920
PCT Pub. Date: Aug. 6, 2020

(65) Prior Publication Data
US 2021/0339413 A1 Nov. 4, 2021

(51) Int. Cl.
*B26B 21/14* (2006.01)

(52) U.S. Cl.
CPC ..... *B26B 21/14* (2013.01)

(58) Field of Classification Search
CPC ..... B26B 21/14; B26B 21/28; B26B 21/40
See application file for complete search history.

(56) References Cited

U.S. PATENT DOCUMENTS 2,472,807 A * 6/1949 Clark ..... B26B 21/18 30/70
4,409,735 A * 10/1983 Cartwright ..... B26B 21/4031 30/346.59
4,443,939 A * 4/1984 Motta ..... B26B 21/4012 30/49
4,516,320 A 5/1985 Peleckis
5,161,307 A 11/1992 Althaus
(Continued)

FOREIGN PATENT DOCUMENTS

CN 101081520 A 12/2007
CN 101722526 A 6/2010
(Continued)

*Primary Examiner* — Stephen Choi
(74) *Attorney, Agent, or Firm* — Shimokaji IP

(57) ABSTRACT

Razor head includes a razor cartridge (10) and a razor blade (20). The razor cartridge (10) contains a front side wall (11), a rear side wall (12), a left side wall (13), and a right side wall (14) which enclose an accommodating space (15) to receiving the razor blade (20). The front side wall (11) has multiple protective ribs (30) protruding upward and arranged at intervals along the length direction of the razor cartridge (10); each protective rib (30) extends along the width direction of the razor cartridge (10) and contains a flexible protective rib (30*a*) and a rigid protective rib which (30*b*) which are joined, the rigid protective rib (30*b*) is located in front of the razor blade (20) and arranged adjacent to the razor blade (20), and a guide groove (31) is enclosed between the two adjacent protective rib (30). The razor head has good shaving performance and good comfort.

13 Claims, 6 Drawing Sheets

(56) References Cited

U.S. PATENT DOCUMENTS

| | | | | |
|---|---|---|---|---|
| 5,781,997 | A * | 7/1998 | Ferraro | B26B 21/4012 30/47 |
| 6,397,473 | B1 * | 6/2002 | Clark | B26B 21/227 30/50 |
| 8,413,334 | B2 * | 4/2013 | Walker, Jr. | B26B 21/4025 30/50 |
| 2003/0159291 | A1 | 8/2003 | Clark | |
| 2005/0102847 | A1 | 5/2005 | King | |
| 2010/0058595 | A1 * | 3/2010 | Walker, Jr. | B26B 21/521 30/77 |
| 2010/0083510 | A1 * | 4/2010 | Clarke | B26B 21/4018 30/346.5 |
| 2011/0067245 | A1 * | 3/2011 | Bridges | B26B 21/222 30/77 |
| 2016/0279817 | A1 * | 9/2016 | Washington | B26B 21/227 |

FOREIGN PATENT DOCUMENTS

| | | | |
|---|---|---|---|
| CN | 102015225 | A | 4/2011 |
| CN | 102639302 | A | 8/2012 |
| CN | 104428108 | A | 3/2015 |
| CN | 105792999 | A | 7/2016 |
| CN | 107000229 | A | 8/2017 |
| CN | 108326904 | A | 7/2018 |

* cited by examiner

RAZOR HEAD

FIELD OF THE INVENTION

The present invention relates to the technical field of shaving, and more particularly to a razor head.

BACKGROUND OF THE INVENTION

With improvement of the economy and the society, abounding consumables are offered to people to satisfy people's demand, thereby improving people's standard or living. Razors are one of these consumables.

Currently, razor head for a razor mainly includes a razor cartridge, blades, and a skin contact member. The razor cartridge includes a front side wall, a rear side wall, a left side wall, a right side wall, and a receiving space enclosed by the four side walls. The blades are located in the receiving space, left ends of the blades are assembled on the left side wall, and right ends of the blades are assembled on the right side wall. The skin contact member is located in front of the blades and assembled on the front side wall. The skin contact member has a plurality of convex strips arranged at intervals along a front and rear direction. A length direction of the convex strip is the same as a length direction of the razor cartridge. Therefore, when the user pulls the razor head for shaving, the convex strips of the skin contact member first tightens the skin and flattens hair roots on the skin, and then the flattened hair roots are removed by the blades behind the skin contact member. Because the existing razor head flattens the hair roots by the convex strips of the skin contact member, and their shaves the hair roots, the hair roots are disorderly during the flattening process. On the one hand, shaving effect is poor, and the number of shaving is increased; on the other hand, the flattened hair roots cannot be ensured to be perpendicular to a cutting direction of the blades, so there is a defect of large shaving resistance, thereby resulting in poor shaving comfort.

Therefore, there is a need tor a razor that improves shaving comfort and has good shaving effect to overcome the above-mentioned drawbacks.

SUMMARY OF THE INVENTION

One objective of the present invention is to provide a razor head that improves shaving comfort and has good shaving effect.

To achieve the above-mentioned objective, a razor head includes a razor cartridge and a razor blade. The razor cartridge includes a front side wall, a rear side wall, a left side wall, and a right side wall. The front side wall and the rear side wall are separated along a width direction of the razor cartridge, and the left side wall and the right side wall are separated along a length direction of the razor cartridge. The front side wall, the rear side wall, the left side wall and the right side wall jointly encloses an accommodating space. The razor blade is located in the accommodating space, a left end of the razor blade is assembled on the left side wall, and a right end of the razor blade is assembled on the right side wall. Furthermore, the front side wall has a plurality of protective ribs protruded upward and arranged at intervals along the length direction of the razor cartridge. Each of the protective ribs is extended along the width direction of the razor cartridge, and each of the protective ribs includes a first protective rib located at the front and a second protective rib located at the rear. Further, the first protective rib is partially embedded in the second protective rib, the first protective rib is flexible relative to the second protective rib, the second protective rib is located in front of the razor blade and arranged adjacent to the razor blade, and a guide groove is enclosed between two adjacent protective ribs.

Preferably, first planes are perpendicular to the length direction of the razor cartridge. A shape of a top surface of the planes is a first arc segment which is upward convex and has a downward center, and a shape of a top surface of the second protective rib projected onto the first plane is a first straight line segment.

Preferably, a bottom surface of the guide groove is lower than a cutting edge of the razor blade.

Preferably, a shape of the bottom surface of the guide groove projected onto the first planes is a second arc segment which is upward convex and has a downward center.

Preferably, the second protective rib also is protruded backwards from a surface of the front side wall for enclosing the accommodating space, and the surface of the front side wall for enclosing the accommodating space is convex with a center on the top of the surface.

Preferably, the razor blade includes at least a first razor blade and a second razor blade that are sequentially spaced apart from front to back. Cutting edges of the first razor blade and the second razor blade are located in a second plane. A shape of the second plane projected on the first plane is a second straight line segment, the first arc segment is located below the second straight line segment, the first straight line segment is inclined backward and upward and intersects the second straight line segment, and a rear end of the first straight line segment is located above the second straight line segment.

Preferably, middle portions of side walls of the two adjacent protective ribs are protruded toward each other, so that the guide groove is narrowed in the middle and enlarged at front and rear ends of the guide groove.

Preferably, a long partition groove with a notch is provided on the first protective rib, and the long partition groove is extended along an extending direction of the protective rib.

Preferably, a rear end of the first protective rib is partially embedded in the second protective rib.

Preferably, a middle part of the rear end of the first protective rib is provided with an embedded support rib, and a rear end surface of the first protective rib fits a front end surface of the second protective rib when the support rib is embedded in the second protective rib.

Preferably, a surface of the first protective rib adjacent to the joint is higher than a surface of the second protective rib adjacent to the joint.

In comparison with the prior art, the front side wall of the razor head in this application has a plurality of protective ribs protruding upward and arranged at intervals along a length direction of the razor cartridge. Each of the protective ribs is extended along the width direction of the razor cartridge, and a guide groove is enclosed between two adjacent protective ribs. During the shaving process, the skin is tightened by the protective ribs. While the skin is tightened, the hair on the tightened skin is guided and aligned by the guide groove, so the hair is guided from front to back in the guide groove. Because the hair goes from front to back in the guide groove, the hair root in the guide groove is in a moderately upright state, thereby ensuring that a blade cutting direction is relatively perpendicular to the hair root in the guide groove. Therefore, the hair roots in the guide groove have less shaving resistance to the razor blades. On the one hand, the razor blade shaves the hair roots more cleanly, and the number of shavings is reduced. On the other hand, the comfort of shaving is increased. Furthermore, each of the protective ribs includes a first protective rib located at the front and a second protective rib located at the rear, and the first protective rib is jointed with the second protective rib. And the second protective rib is located in front of the razor blade and arranged adjacent to the razor blade. Therefore, with the help of the first protective rib at the front, the comfort of the razor head is increased when the razor head comes into contact with the skin. With the help of the second protective rib at the rear, when the skin is tightened, the deformation of the hair in the guide groove caused by the first protective rib is reduced, because hair deformation will affect direction of the hair from front to back, thus ensuring that the hair in the guide groove will align from front to back. Therefore, the shave comfort and shaving effect of the razor head in this application are improved.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
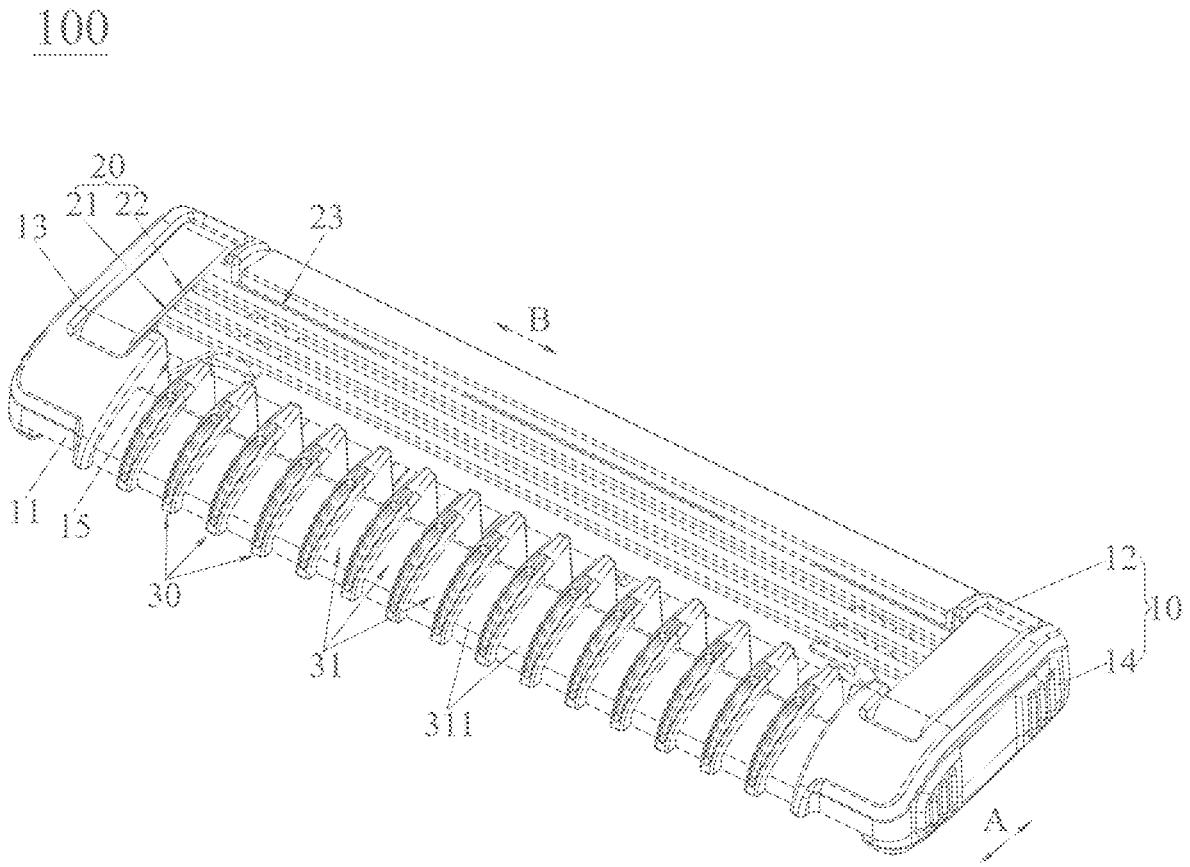
FIG. 1 is a perspective view of a razor head according to an embodiment of the present invention.

A distinct and full description of the technical solution of the present invention will follow by combining with the accompanying drawings.

As shown in FIGS. 1-3 and 5, the razor head 100 includes a razor cartridge 10 and a razor blade 20. Specifically, the razor cartridge 10 includes a front side wall 11, a rear side wall 12, a left side wall 13 and a right side wall 14. Further, the front side wall 11 and the rear side wall 12 are separated along in a width direction of the razor cartridge 10, and the width direction of the razor cartridge 10 refers to a double arrow A. The left side wall 13 and the right side wall 14 are separated in a length direction of the razor cartridge 10, and the length direction of the razor cartridge 10 refers to a double arrow B. Specifically, the front side wall 11, the rear side wall 12, and the left side wall 13 and the right side wall 14 jointly enclose an accommodating space 15. Preferably, the front side wall 11, the rear side wall 12, the left side wall 13, and the right side wall 14 are integrally molded by injection molding, and the accommodating space 15 enclosed by the four side walls is roughly rectangular to simplify the manufacturing process of the razor cartridge 10, but its shape is not limited to this. The razor blade 20 is located in the accommodating space 15, and the hair shaved by the razor blade 20 is removed by the accommodating space 15. A left end of the razor blade 20 is assembled on the left side wall 13 and supported by the left side wall 13, and a right end of the razor blade 20 is assembled on the right side wall 14 and supported by the right side wall 14, so that a length of the razor blade 20 is consistent with that of the razor cartridge 10, and the razor blade 20 is suspended in the accommodating space 15.

Please refer to FIGS. 1-3 and 5 again, the front side wall 11 has 15 protective ribs 30 that are protruded upward and arranged at intervals along the length direction of the razor cartridge 10. Preferably, all the protective ribs 30 are arranged at equal intervals on the front side wall 11 along the length direction of the razor cartridge 10, so that the protective ribs 30 are evenly arranged at the front side wall 11, but it not limited to this. Each of the protective ribs 30 is extended along the width direction of the razor cartridge 10. Preferably, an extending direction of each protective rib 30 is perpendicular or substantially perpendicular to the length direction of the razor cartridge 10, so that the razor blade 20 has a shaving angle to improve the shaving effect, but it not limited to it. Specifically, each of the protective ribs 30 includes a first protective rib **30*a* located at the front and a second protective rib 30*b* located at the rear, and the first protective rib 30*a* is engaged with the second protective rib 30*b*. Preferably, the first protective rib 30*a* is higher than the second protective rib 30*b* at the joint, so that the tightened skin is lifted up at the joint and then slides smoothly to the second protective rib 30*b*, thereby preventing rigid collision between the second protective rib 30*b* and skin and further improving the comfort of shaving, but it is not limited to it. Furthermore, the second protective rib 30*b* is located in front of the razor blade 20 and arranged adjacent to the razor blade 20, and a guide groove 31 is enclosed between two adjacent protective ribs 30. For example, the first protective rib 30*a* is protruded forward from the front side wall 11 to prevent the front side wall 11 from contacting the skin when the skin is tightened by the first protective rib 30*a*. Specifically, the first protective rib 30*a* is flexible relative to a rigid material, and the second protective rib 30*b* is rigid relative to another flexible material. Understandably, hardness of the first protective rib 30*a* and the second protective rib 30*b* are different, and the first protective rib 30*a* is flexible relative to the second protective rib 30*b*, Preferably, the first protective rib 30*a* may be made of thermoplastic elastic, and the second protective rib 30*b* may be made of plastic material, but it is not limited to it. Understandably, the protective ribs 30 can be integrally formed with the razor cartridge 10 by insert molding. Of course, it can also be formed by cold forming, hot riveting, bonding, or other ways well known to those skilled in the art. In addition, substantially perpendicular above means that an angle between a length direction of the protective rib 30 and the length direction of the razor cartridge 10 is in a range of 90 degrees with a positive or negative deviation, such as a positive deviation of 1 degree (91 degrees) or a negative deviation of 1 degree (89 degrees). The number of the protective ribs 30** can also be 6, 7, 8, 9, 10, 11, 12, 13 or 14, but it is not limited to this.

Figure 3:
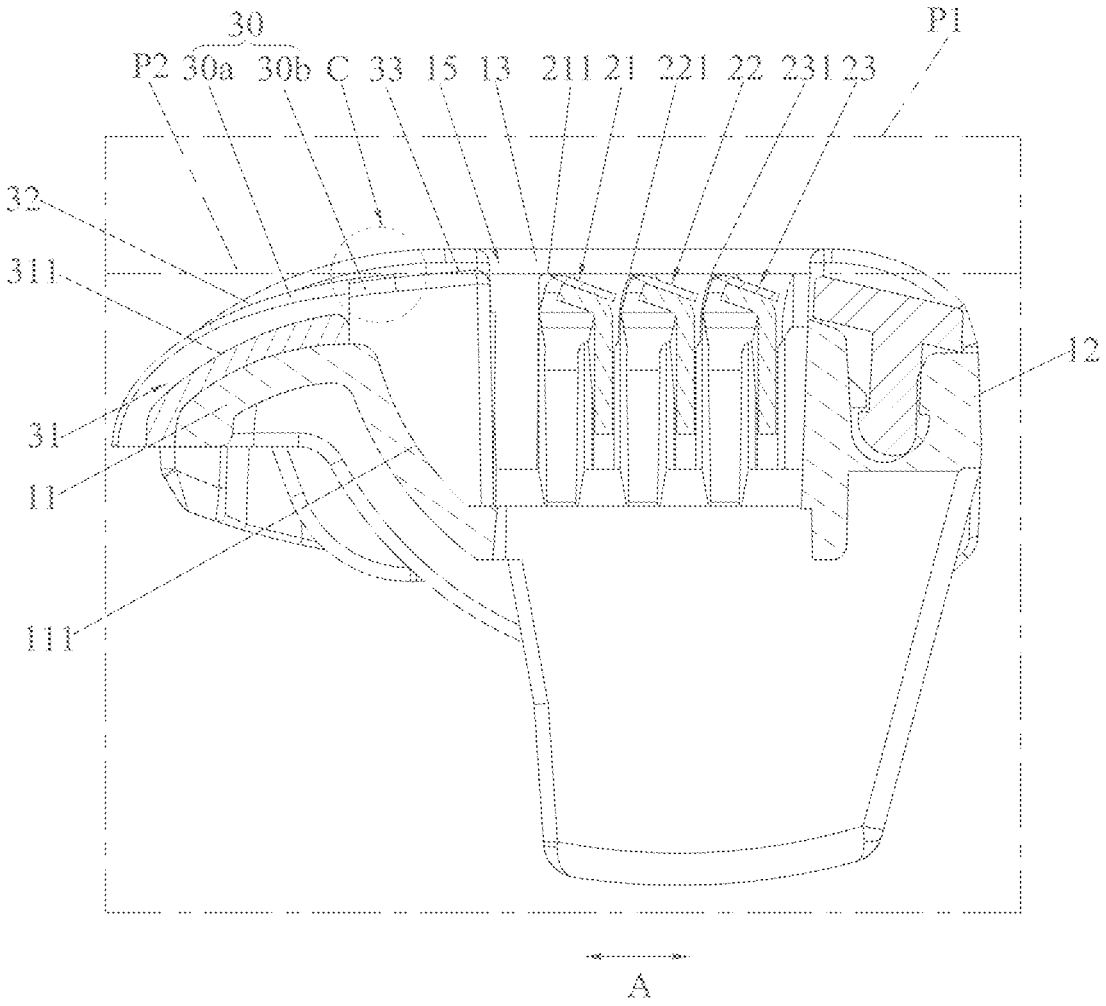
FIG. 3 is a cross-sectional view of the razor head along the E-E line in FIG. 2.
Figure 4:
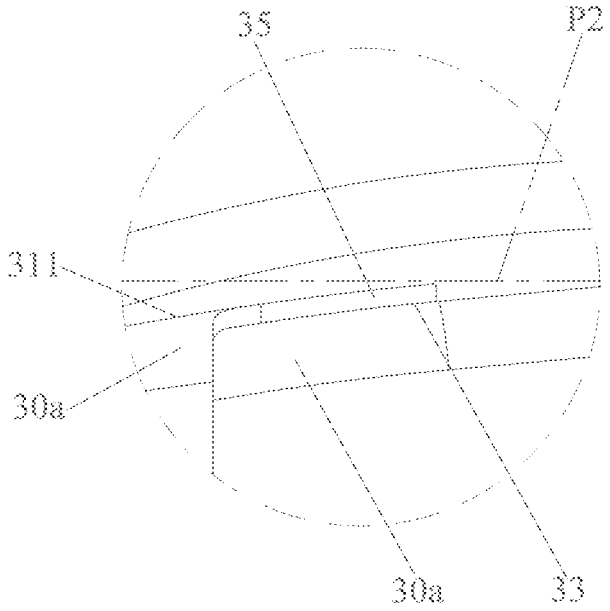
FIG. 4 is an enlarge view of section C in FIG. 3.
Figure 5:
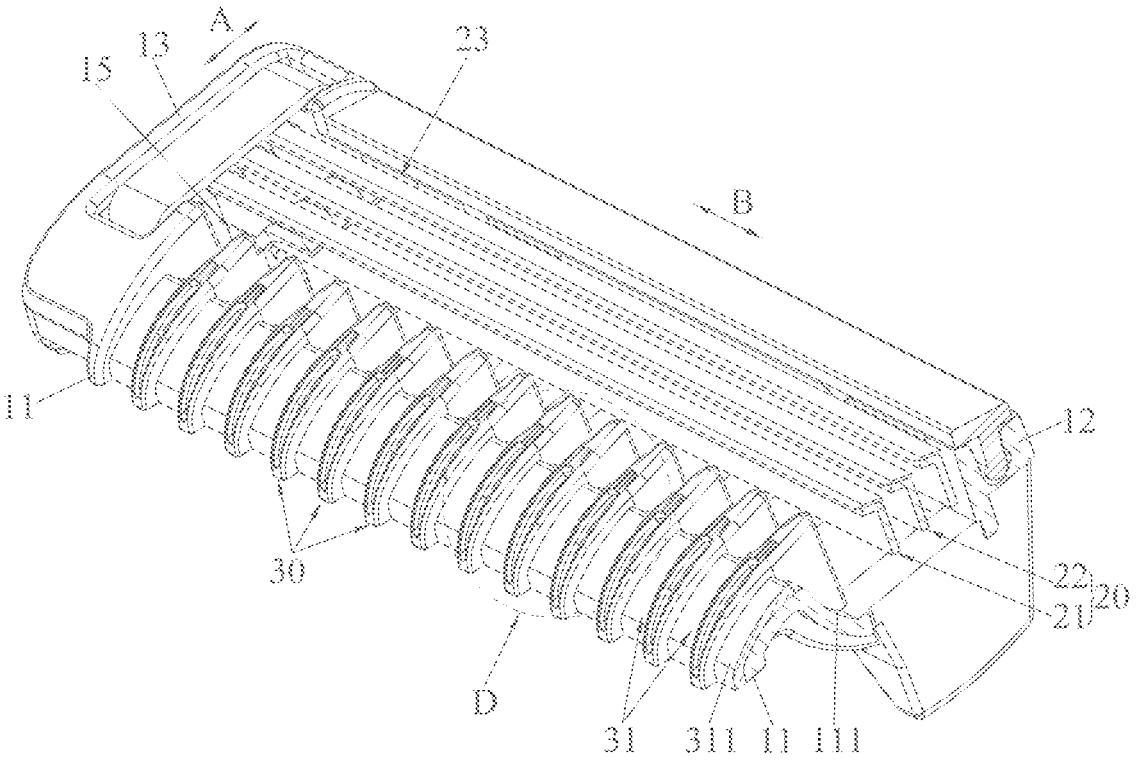
FIG. 5 is a perspective view of the razor head after sectioned along the E-E line in FIG. 2.
Figure 6:
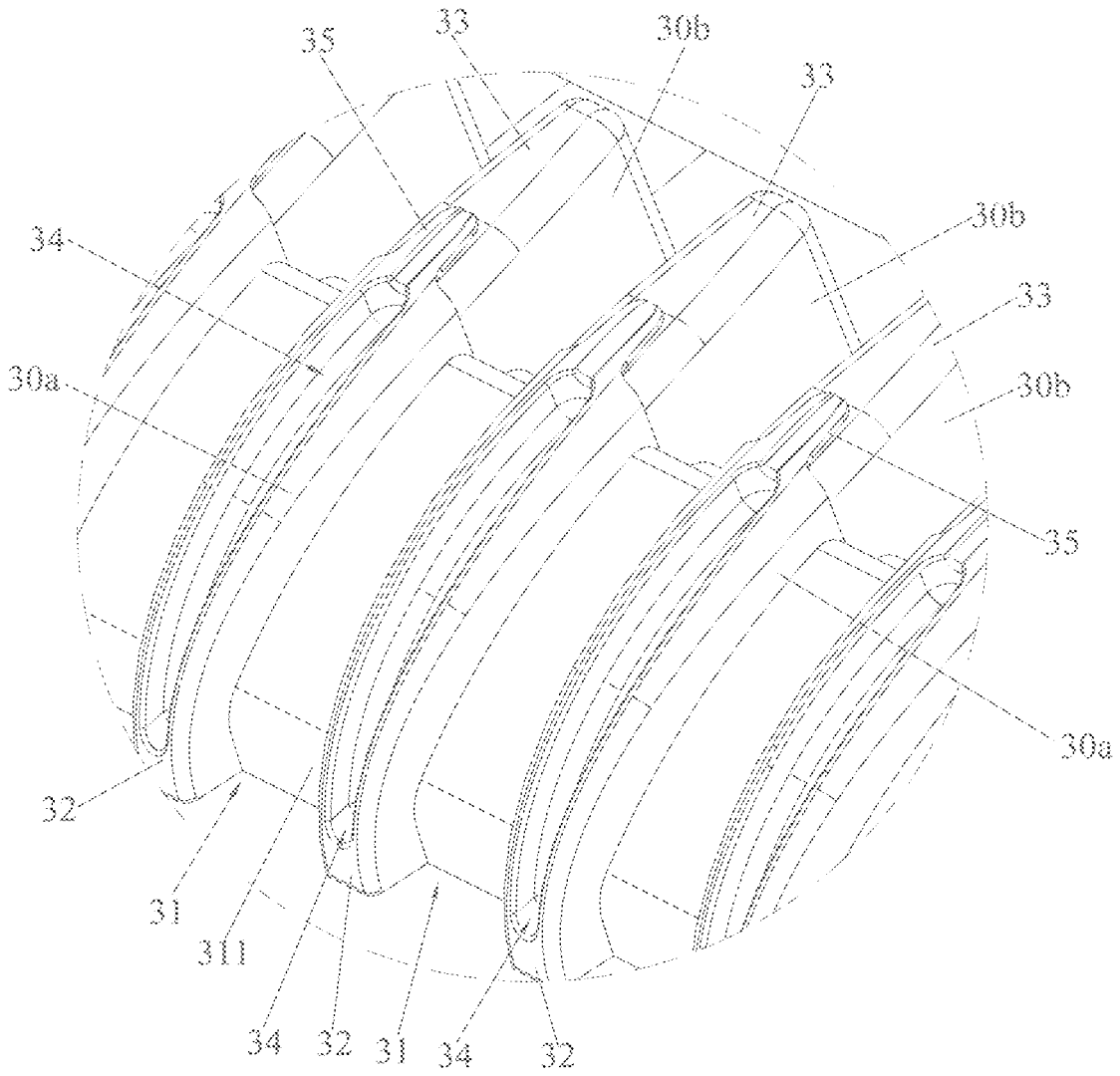
FIG. 6 is an enlarge view of section D in FIG. 5.

As shown in FIG. 3, a first plane P1 is perpendicular to the length direction of the razor cartridge 10, and a projection of a top surface 32 of the first protective rib **30*a* on the first plane P1 is a first arc segment which is upward convex and has a downward center. Further, a projection of a top surface 33 of the second protective rib 30*b* on the first plane P1 is a first straight line segment. So the first protective rib 30*a* rolls along the skin surface during the shaving process to tighten the skin, thereby making the razor head 100 better contact to the skin. Specifically, a bottom surface 311 of the guide groove 31 is lower than a cutting edge 211 of the razor blade 20 for avoiding that hairs in the guide groove 31 from passing over the cutting edge 211 which results from that the bottom surface 311 is higher than the cutting edge 211 and which results in that the hairs can not be cut by the razor blade 20. Therefore, the bottom surface 311 of the guide groove 31 is lower than the cutting edge 211, so that the hair in the guide groove 31 goes below the cutting edge 211. This arrangement can more cleanly and thoroughly shave the hair roots in the guide groove 31 from front to back. Preferably, a projection of the bottom surface 311 of the guide groove 31 on the first plane P1 is a second arc segment which is upward convex and has a downward center. In this way, the hair roots entering the guide groove 31 are arched along the bottom surface 311 of the guide groove 31, so that the hair roots in the guide groove 31 are in a relatively vertical state when the hair roots slide near the razor blade 20. Such a design enables the razor blade 20 to cut in a direction perpendicular to the hair root, reducing the shaving resistance of the hair root to the razor blade 20, and further improving the shaving effect. Furthermore, the second protective rib 30***b* is also protruded backwards from a surface 111 of the front side wall 11 for enclosing the accommodating space 15, and the surface 111 of the front side wall 11 is an arc surface which is downward convex and has an upward center. On the one hand, the surface 111 having the arc surface facilitates that the shaved beard falling on the surface 111 slides along the surface 111 to a bottom of the accommodating space 15 and is discharged; on the other hand, because the bottom surface 311 of the guide groove 31 is lower than the cutting edge 211 of the razor blade 20, the hair in the guide groove 31 is bent downwards and lies below the cutting edge 211 when moved from front to back, which further improves the shaving effect of the cutting edge 211, but it not limited to this.

As shown in FIGS. 1-3 and 5, the razor blade 20 includes a first razor blade 21, a second razor blade 22, and a third razor blade 23 that are sequentially spaced apart from front to back. A cutting edge 211 of the first blade 21 and a cutting edge 221 of the second blade 22 are located in a second plane P2. A projection of the second plane P2 on the first plane P1 is a second straight line segment, and the first arc segment is located below the second straight line segment. The first straight line segment is inclined backward and upward and intersects the second straight line segment, and a rear end of the first straight line segment is located above the second straight line segment. Therefore, a rear end of the second protective rib 30*b* adjacent to the first razor blade 21 is slightly higher than the first razor blade 21 and a second razor blade 22 which are used to limit a contact distance between the first razor blade 21 and the second razor blade 22 and the skin, which effectively prevents the risk of the first razor blade 21 and the second razor blade 22 from cutting the skin. Preferably, a cutting edge 231 of the third razor blade 23 is also located in the second plane P2, and the cutting edge 211, the cutting edge 221, and the cutting edge 231 are parallel to each other, but it is not limited thereto. Understandably, according to actual needs, the razor blade 20 may include the first razor blade 21 and the second razor blade 22 spaced apart from front to back, so the above example is not limited.

Figure 2:
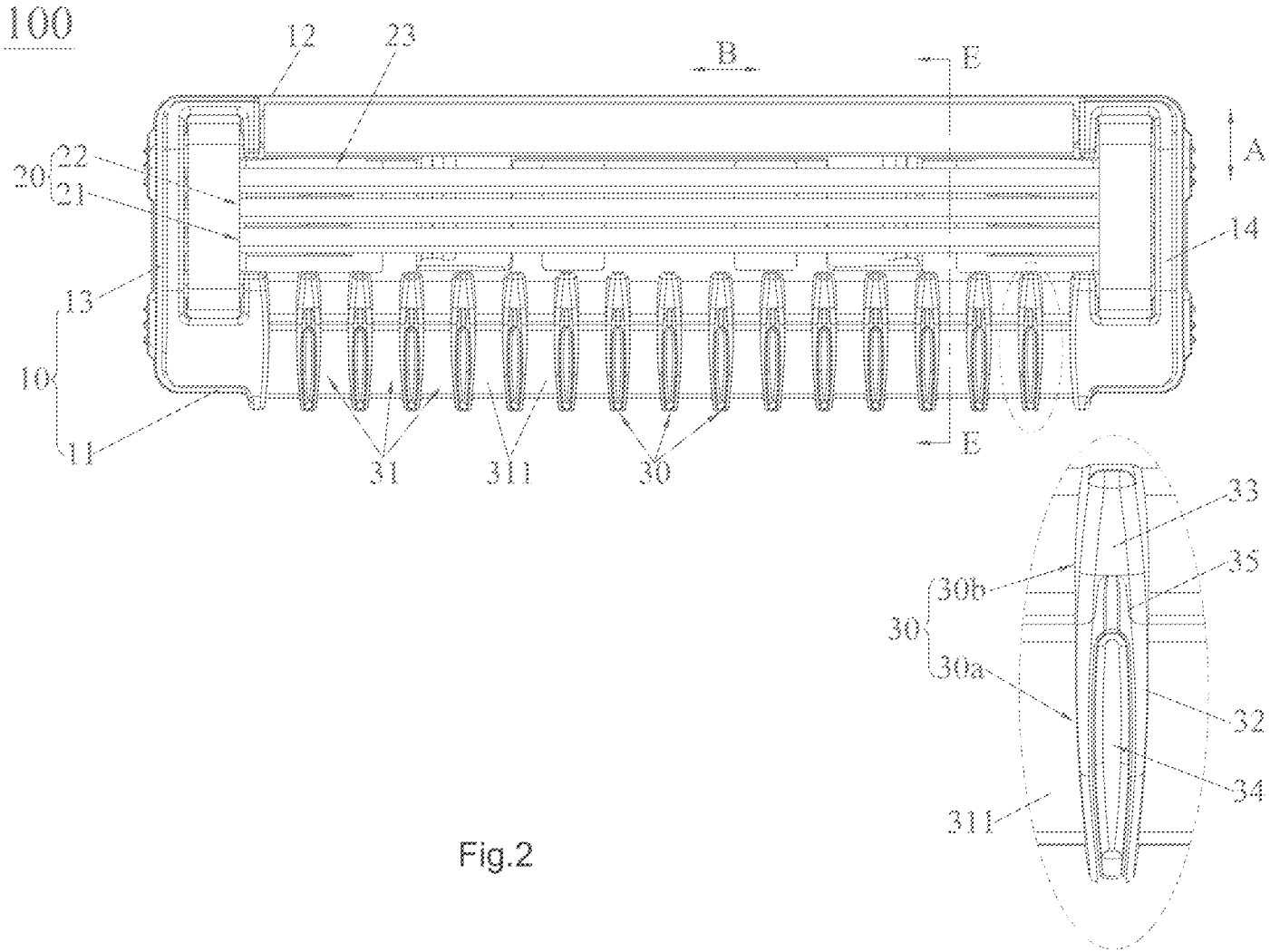
FIG. 2 is a plan view of the razor head shown in FIG. 1.

As shown in FIG. 2, middle portions of the side walls of the two adjacent protective ribs 30 are protruded toward each other, so that the guide groove 31 is narrowed in the middle and enlarged at the front and rear ends. Such a structure is beneficial to the hair entering the guide groove 31, guide and align the hair when the hair enters the guide groove 31, and make the hair root keep in an upright state in the guide groove 31, thereby ensuring that the hair is removed by the razor blade 20.

As shown in FIGS. 1-2 and 5-6, the first protective rib 30*a* is opened with a long partition groove 34 with a notch facing upward. The long partition groove 34 is extended along an extending direction of the protective rib 30, so that a length direction of the long partition groove 34 is the same as a length direction of the first protective rib 30*a*. This arrangement makes the first protective rib 30*a* more flexible and comfortable in contact with the skin, and further increases the shaving comfort. Specifically, as shown in FIGS. 3 to 6, a rear end of the first protective rib 30*a* is partially embedded in the second protective rib 30*b*, so that the two are connected stably. Preferably, a middle part of the rear end of the first protective rib 30*a* is provided with an embedded support rib 35, and a rear end surface of the first protective rib 30*a* fits a front end surface of the second protective rib 30*b* when the embedded support rib 35 is embedded in the second protective rib 30*b*. With the help of the embedded support rib 35, the first protective rib 30*a* adopts a smaller part to achieve a purpose that the first protective rib 30*a* is higher than the second protective rib 30*b* at the joint. But it is not limited to this.

In comparison with the prior art, the front side wall 11 of the razor head 100 in this application has a plurality of protective ribs 30 protruded upward and arranged at intervals along a length direction of the razor cartridge 10. Each of the protective ribs 30 is extended along a width direction of the razor cartridge 10, and a guide groove 31 is enclosed between two adjacent protective ribs 30. During the shaving process, the skin is tightened by the protective ribs 30. While the skin is tightened, the hair on the tightened skin is guided and aligned by the guide groove 31, so the hair is guided from front to back in the guide groove 31. Because the hair goes from front to back in the guide groove 31, the hair root in the guide groove 31 is in a moderately upright state, thereby ensuring that a blade cutting direction is relatively perpendicular to the hair root in the guide groove 31. Therefore, the hair roots in the guide groove 31 have less shaving resistance to the razor blade 20. On the one hand, the razor blade 20 shaves the hair roots more cleanly, and the number of shavings is reduced. On the other hand, the comfort of shaving is increased. Furthermore, each of the protective ribs 30 includes a first protective rib 30*a* located at the front and a second protective rib 30*b* located at the rear, and the first protective rib 30*a* is jointed with the second protective rib 30*b*. And the second protective rib 30*b* is located in front of the razor blade 20 and arranged adjacent to the razor blade 20. Therefore, with the help of the first protective rib 30*a* at the front, the comfort of the razor head 100 is increased when the razor head 100 contacts with the skin. With the help of the second protective rib 30*b* at the rear, when the skin is tightened, the deformation of the hair in the guide groove 31 caused by the first protective rib 30*a* is reduced, hair deformation will affect direction of the hair from front to back, thus ensuring that the hair in the guide groove 31 will align from front to back. Therefore, the shave comfort and shaving effect of the razor head 100 in this application are improved.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. A razor head comprising a razor cartridge and a razor blade, and the razor cartridge comprising a front side wall, a rear side wall, a left side wall, and a right side wall, the front side wall and the rear side wall being separated along a width direction of the razor cartridge, the left side wall and the right side wall being separated along a length direction of the razor cartridge, the front side wall, the rear side wall, the left side wall and the right side wall jointly enclosing an accommodating space, the razor blade being located in the accommodating space, a left end of the razor blade being assembled on the left side wall, and a right end of the razor blade being assembled on the right side wall;

wherein the front side wall has a plurality of protective ribs protruded upward and arranged at intervals along the length direction of the razor cartridge, each of the protective ribs is extended along the width direction of the razor cartridge, each of the protective ribs includes a first protective rib located at the front and a second protective rib located at the rear, the first protective rib is flexible relative to the second protective rib, the first protective rib is partially embedded in the second protective rib, the second protective rib is located in front of the razor blade and arranged adjacent to the razor blade, and a guide groove is enclosed between two adjacent protective ribs.

2. The razor head according to claim 1, wherein first planes are perpendicular to the length direction of the razor cartridge, a shape of a top surface of the first protective rib projected onto the first planes is a first arc segment which is upward convex and has a downward center, and a shape of a top surface of the second protective rib projected onto the first plane is a first straight line segment.

3. The razor head according to claim 2, wherein a bottom surface of the guide groove is lower than a cutting edge of the razor blade.

4. The razor head according to claim 2, wherein a shape of a bottom surface of the guide groove projected onto the first planes is a second arc segment which is upward convex and has a downward center.

5. The razor head according to claim 2, wherein the second protective rib also is protruded backwards from a surface of the front side wall for enclosing the accommodating space, and the surface of the front side wall for enclosing the accommodating space is convex with a center on the top of the surface.

6. The razor head according to claim 2, wherein the razor blade comprises at least a first razor blade and a second razor blade that are sequentially spaced apart from front to back, cutting edges of the first razor blade and the second razor blade are located in a second plane, a shape of the second plane projected onto the first planes is a second straight line segment, the first arc segment is located below the second straight line segment, the first straight line segment is inclined and intersects the second straight line segment, and a rear end of the first straight line segment is located above the second straight line segment.

7. The razor head according to claim 2, wherein middle portions of side walls of the two adjacent protective ribs are protruded toward each other, so that the guide groove is narrowed in the middle and enlarged at front and rear ends of the guide groove.

8. The razor head according to claim 2, wherein a long partition groove with a notch is provided on the first protective rib, and the long partition groove is extended along an extending direction of the protective rib.

9. The razor head according to claim 2, wherein a rear end of the first protective rib is partially embedded in the second protective rib.

10. The razor head according to claim 9, wherein a middle part of the rear end of the first protective rib is provided with an embedded support rib, and a rear end surface of the first protective rib fits a front end surface of the second protective rib when the support rib is embedded in the second protective rib.

11. The razor head according to claim 1, wherein a surface of the first protective rib adjacent to the joint is higher than a surface of the second protective rib adjacent to the joint.

12. A razor head comprising a razor cartridge and a razor blade, and the razor cartridge comprising a front side wall, a rear side wall, a left side wall, and a right side wall, the front side wall and the rear side wall being separated along a width direction of the razor cartridge, the left side wall and the right side wall being separated along a length direction of the razor cartridge, the front side wall, the rear side wall, the left side wall and the right side wall jointly enclosing an accommodating space, the razor blade being located in the accommodating space, a left end of the razor blade being assembled on the left side wall, and a right end of the razor blade being assembled on the right side wall;

wherein the front side wall has a plurality of protective ribs protruded upward and arranged at intervals along the length direction of the razor cartridge, each of the protective ribs is extended along the width direction of the razor cartridge, each of the protective ribs includes a first protective rib located at the front and a second protective rib located at the rear, the first protective rib is flexible relative to the second protective rib, the first protective rib is engaged with the second protective rib, the second protective rib is located in front of the razor blade and arranged adjacent to the razor blade, and a guide groove is enclosed between two adjacent protective ribs;

first planes are perpendicular to the length direction of the razor cartridge, a shape of a top surface of the first protective rib projected onto the first planes is a first arc segment which is upward convex and has a downward center, and a shape of a top surface of the second protective rib projected onto the first plane is a first straight line segment; and the second protective rib also is protruded backwards from a surface of the front side wall for enclosing the accommodating space, and the surface of the front side wall for enclosing the accommodating space is convex with a center on the top of the surface.

13. A razor head comprising a razor cartridge and a razor blade, and the razor cartridge comprising a front side wall, a rear side wall, a left side wall, and a right side wall, the front side wall and the rear side wall being separated along a width direction of the razor cartridge, the left side wall and the right side wall being separated along a length direction of the razor cartridge, the front side wall, the rear side wall, the left side wall and the right side wall jointly enclosing an accommodating space, the razor blade being located in the accommodating space, a left end of the razor blade being assembled on the left side wall, and a right end of the razor blade being assembled on the right side wall;

wherein the front side wall has a plurality of protective ribs protruded upward and arranged at intervals along the length direction of the razor cartridge, each of the protective ribs is extended along the width direction of the razor cartridge, each of the protective ribs includes a first protective rib located at the front and a second protective rib located at the rear, the first protective rib is flexible relative to the second protective rib, the first protective rib is engaged with the second protective rib, the second protective rib is located in front of the razor blade and arranged adjacent to the razor blade, and a guide groove is enclosed between two adjacent protective ribs; and a long partition groove with a notch is provided on the first protective rib, and the long partition groove is extended along an extending direction of the protective rib.

* * * * *